United States Patent [19]

Matsushiro

[11] Patent Number: 4,480,401

[45] Date of Patent: Nov. 6, 1984

[54] RADIO-CONTROLLED CAR

[75] Inventor: Yukimitsu Matsushiro, Tokyo, Japan

[73] Assignee: Kabushiki Kaisha Matsushiro, Tokyo, Japan

[21] Appl. No.: 460,896

[22] Filed: Jan. 25, 1983

[30] Foreign Application Priority Data

Dec. 15, 1983 [JP] Japan ..... 57-189425[U]

[51] Int. Cl.[3] ..... A63H 00/00

[52] U.S. Cl. ..... 446/456; 446/460; 446/437

[58] Field of Search ..... 46/210, 213, 251, 253, 46/254, 255, 262

[56] References Cited

U.S. PATENT DOCUMENTS 4,171,592 10/1979 Saitoh ..... 46/262 X 4,183,174 1/1980 Barris et al. ..... 46/254

FOREIGN PATENT DOCUMENTS 1324721 3/1963 France ..... 46/213

*Primary Examiner*—F. Barry Shay

*Attorney, Agent, or Firm*—Lane, Aitken & Kananen

[57] ABSTRACT

In a radio-controlled car which is wirelessly controlled and capable of moving in a wheelie running state, the radio-controlled car comprises a braking member which is moved by a servomotor actuated in accordance with a direction turning command signal transmitted from a control box, an auxiliary wheel adapted to be rolled along the ground in the wheelie running mode, which can be turned in linkage of the braking member, and further a drive wheels repressing mechanism by which the intended turning direction side rear wheel, fixed to a drive axles connected through a differential gear, is repressed by the braking member so that, it can easily be turned even when it is in the wheelie running mode.

8 Claims, 4 Drawing Figures

RADIO-CONTROLLED CAR

BACKGROUND OF THE INVENTION

1. Field of the Invention

This invention relates generally to a radio-controlled car, more specifically to a particular type of radio controlled car which can be operated in the so-called wheelie running such that the car runs on only rear wheels while raising the front wheels, and further turns from the forward direction even when the car runs on in the wheelie running state.

2. Description of the Prior Art

Conventionally, there has been a radio controlled car which runs with the front wheels raised, so called wheelie running. Such type radio controlled car is so designed in order to shift from the normal running mode to the wheelie running mode that the front wheels are raised by means of moving the center of gravity due to the reaction caused when the forward running speed of the radio controlled car is accelerated.

In such conventional case, however, it is impossible to turn from the forward direction with the front wheels raised since, the wheelie running can be conducted only when the car runs in the straight direction. Thus, such conventional radio controlled car is not turned at all during the wheelie running so that it may go straight and crash into an obstacle.

SUMMARY OF THE INVENTION

It is therefore an object of the present invention to overcome the demerits of such conventional radio controlled car and to provide an improved radio controlled car which can freely turn from the forward direction regardless of wheelie running state.

Namely, in accordance with the present invention, a radio-controlled car which is wirelessly controlled and capable of moving in a wheelie running state, comprises a pair of drive axles which are connected to each other through a differential gear, driving wheels one of which is fixed to each one of said pair of drive axles, a servomotor which is actuated in response to a command signal transmitted from a box control for turning from the forward direction, a braking mechanism which is moved in linkage with said servomotor so as to brake said driving wheel of the turning side to repress the revolution of the wheel, following wheels which are turned to the intended turning direction in linkage with said braking mechanism, and an auxiliary wheel which is turned to the intended turning direction in linkage with said braking mechanism and rolls along the ground during only the wheelies running state.

The above and other object features and advantages of the present invention will be apparent from the following description of a preferred embodiment thereof, taken in conjunction with the accompanying drawing.

DESCRIPTION OF THE PREFERRED EMBODIMENT

Figure 1:
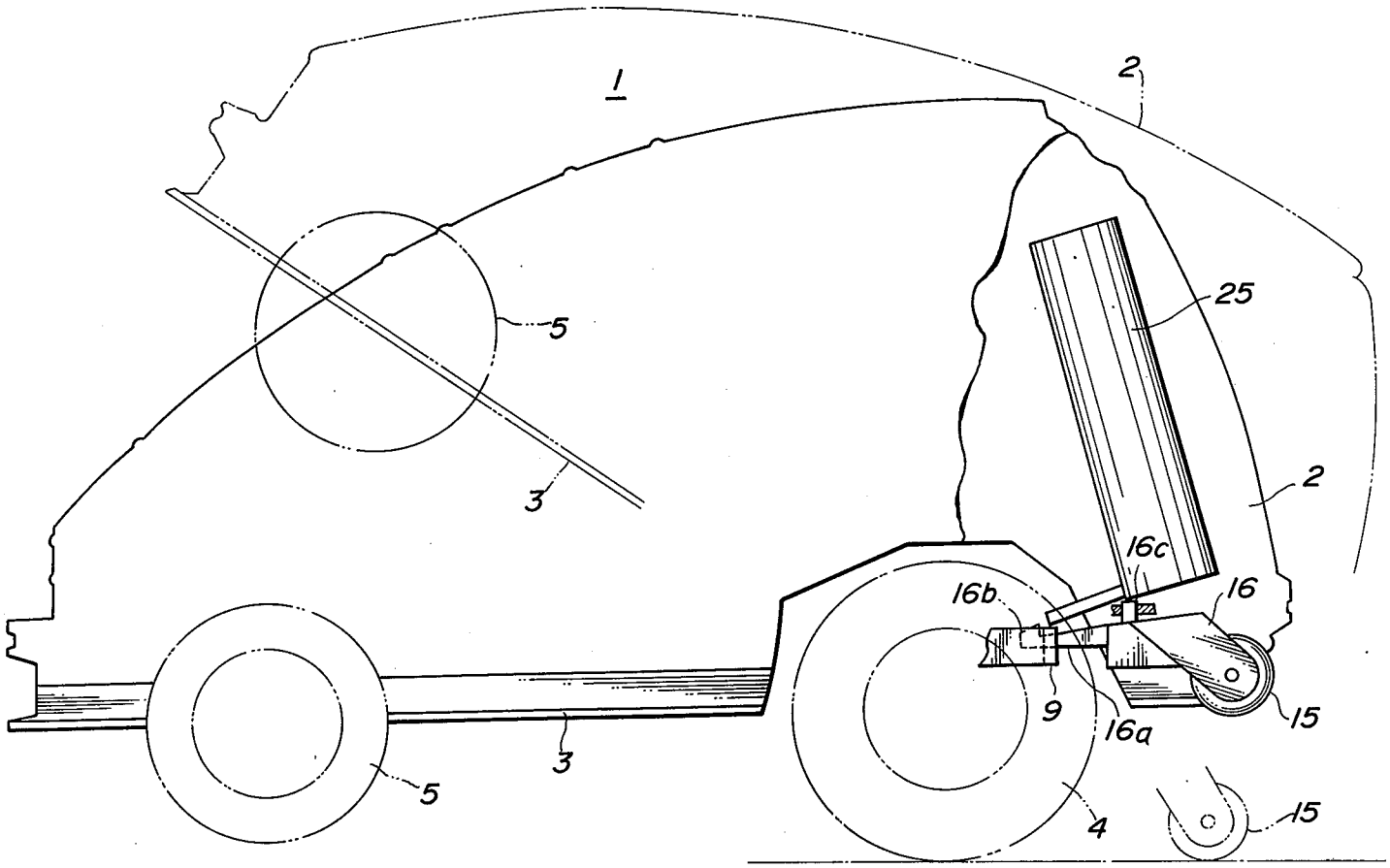
FIG. 1 is a side view showing a substantial structure of the radio controlled car according to the present invention.

Hereinbelow, the present invention will be explained in detail with respect to an embodiment shown in the drawings.

Referring to FIG. 1, there is shown a preferred embodiment of the present invention. In the figure, a radio controlled car 1 according to the present invention comprises a body 2, a chassis 3 integrally assembled thereto, rear wheels 4 as driving wheels, and front wheels 5 as following wheels, and the front and rear wheels secured to the chassis.

The rear wheels 4 are respectively fixed to drive axles 4*a* independently of each other, and the drive axles 4*a* are respectively fixed to side gears 7*a* which compose a differential gear 7 housed in a differential gear box 6.

Figure 2:
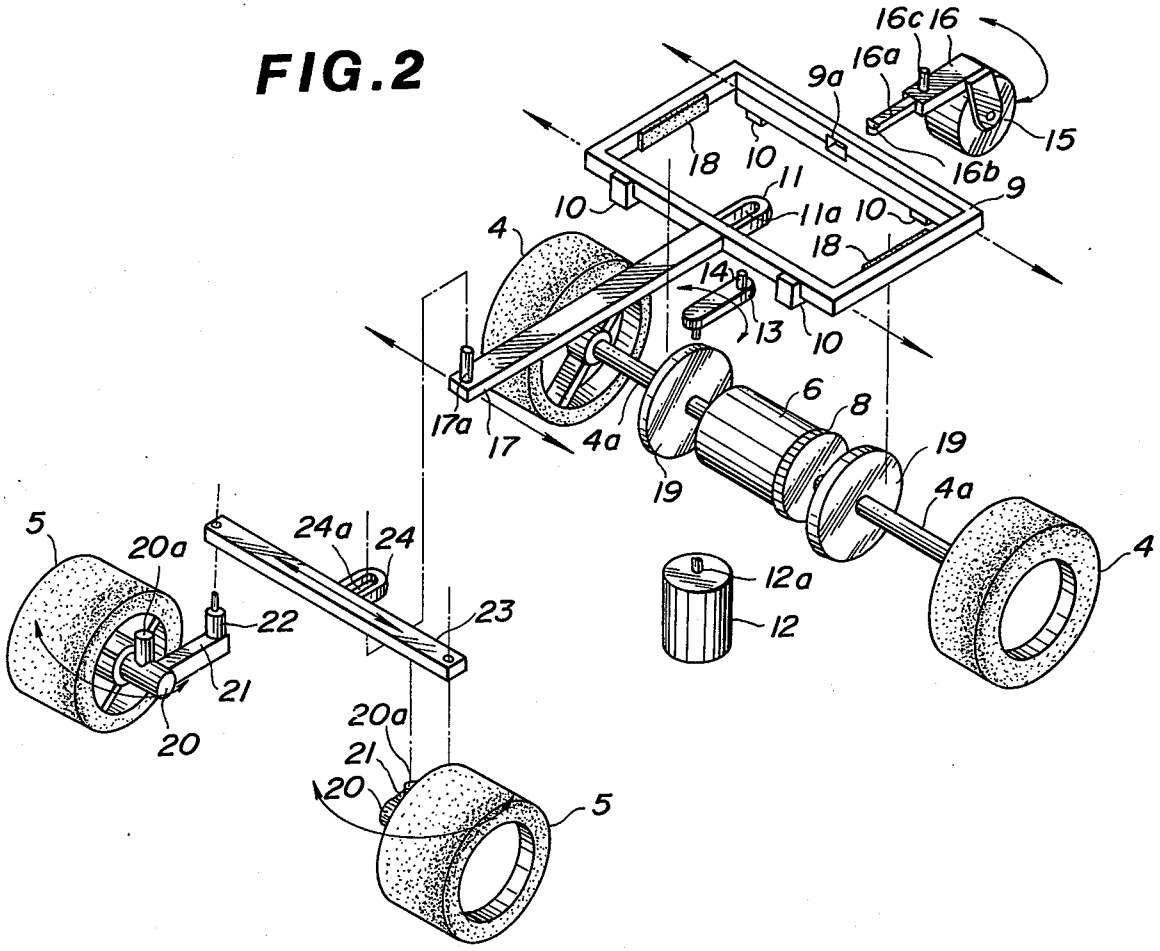
FIG. 2 is an exploded perspective view showing a mechanism for turning from the forward direction of the car.
Figure 3:
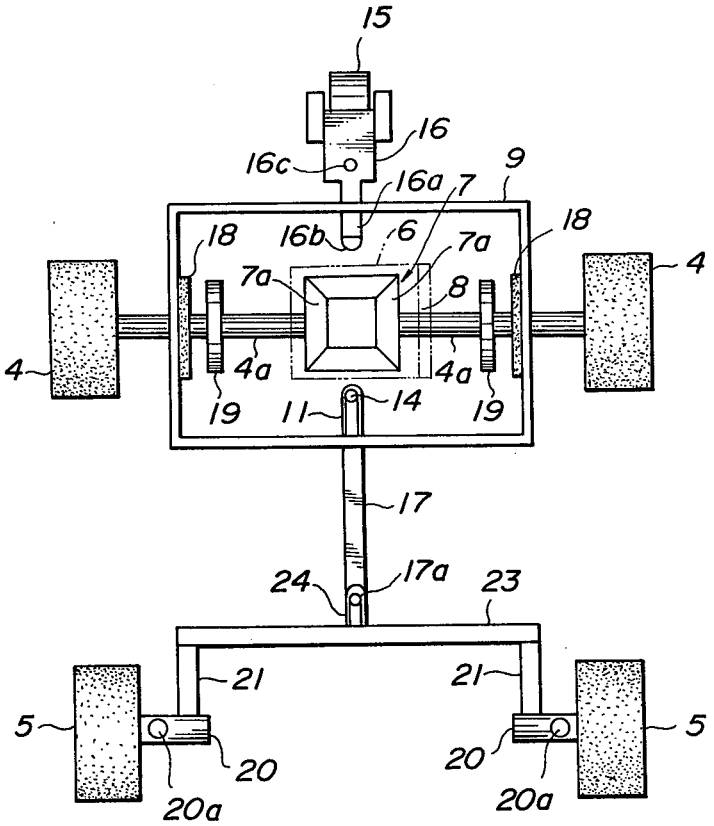
FIG. 3 is a plan view showing the forward direction turning mechanism.

The differential gear box 6 is integrally fixed with a gear 8 (refer to FIG. 2), which is meshed with a gear fixed to the output shaft of a motor, not shown, through an intermediate gear. Thus, the gear 8 is resolved in response to the revolution of the motor. Further, the revolving force is transmitted to the rear wheel 4 through the drive axle 4*a*.

Over the differential gear box 6 there is disposed a braking member 9 in the shape of a rectangular frame. The braking member 9 is allowed to be freely moved in the horizontal direction along guide members 10 protruding from the chassis 3. According to this movement, the braking mechanism can apply the brake to the rear wheel 4 which is on the side of the intended turning direction in the following manner.

A protruding member 11 having a U shape figure is projectingly secured to the center and inside surface of the front side of the braking member 9 (with respect to the forward direction of the radio controlled car 1), and the protruding member 11 is formed with a slot-shape opening 11*a* along the axis of the car.

On the other hand, the reference numeral 12 denotes a servo-box mainly consisting of a servomotor. The top of an output shaft 12*a* of the servomotor is fixed with a rotatable lever 13, and a pin 14 is protrudingly secured on the upper surface of the free end of the rotatable lever 13. This pin 14 is allowed to be engaged with the slot 11*a* of the protruding member 11.

In such composition, when the servomotor in the servo-box 12 revolves in response to radio-waves transmitted from a control box, not shown, the rotatable lever 13 is rotated responsive to the revolved angle of the motor. Accordingly, the braking member 9 may be moved leftwards or rightwards in the horizontal direction through the pin 14 and the protruding member 11 engaged with the pin 14. Since the rotatable lever 13 is always biased by the returning force of a spring not shown so as to urge the rotatable lever 13 backwards, it will quickly return to the normal position. According to this returning movement, the braking member 9 will also return to the neutral position quickly.

Figure 4:
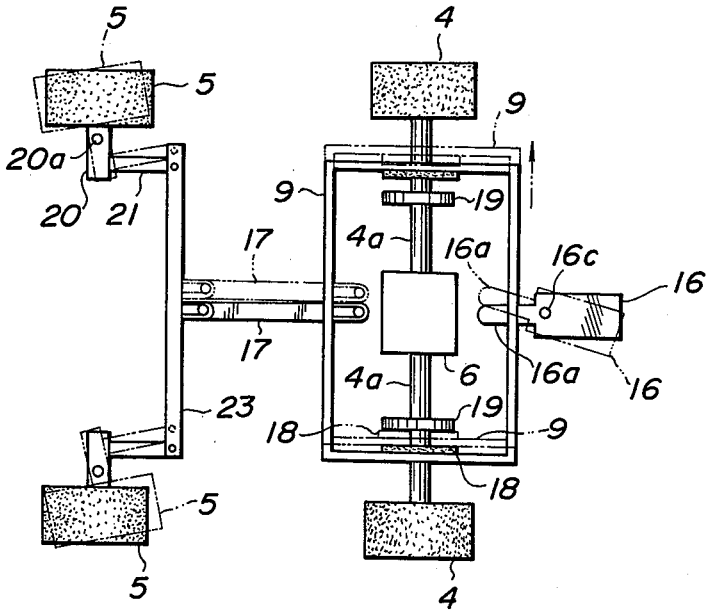
FIG. 4 is a plan view showing an operation of the forward direction turning mechanism.

On the other hand, at the rear side of the braking member 9, a lever 16 is pivotably secured to the chassis 3 through a pin 16*c*. The lever 16 rotatably supports an auxiliary wheel 15 which will roll along the ground during the wheelie running state so as to support the rear of the body 2. The lever 16 is further extendingly formed with a protruding bar 16*a* at the forward end thereof. This protruding bar 16*a* is loosely engaged within a rectangular opening 9a formed in the rear frame side of the braking member 9 and prevented from disengaging with the opening 9a owing to a hooked end 16b formed at the most forward end of the protruding bar 16a. According to this constitution, when the braking member 9 is moved leftwards or rightwards, the rear portion of the lever 16, supporting the auxiliary wheel 15, will be rotated rightwards or leftwards about the pin 16c in the reverse direction of the braking member. That is, referring to FIG. 4, the double dotted chain line shows the movement of the front wheels 5 and the lever 16 supporting the auxiliary wheel 15 when the braking member 9 is moved rightwards. In the same manner as the above, the movement of the front wheels 5 and the lever 16 supporting the auxiliary wheel 15 is switched to the opposite direction of the double dotted chain line when the braking member 9 is moved leftwards.

In addition to the above composition, a rod 17 is forward-extendingly secured to the side of the front frame of the braking member 9 in opposition to the protruding member 11, and a pin 17a is formed upwardly at the front end surface of the rod 17.

The braking member 9 is further composed of a pair of brake linings 18 which are respectively secured to the inner surface on the left and right side frames of the braking member 9. Thus, each of the brake linings 18 is so arranged as to face the outer surface of disk plates 19 which are fixed to the drive axles 4a at both sides of the differential gear box 6. According to this arrangement, one of the brake linings 18 will contact with the corresponding disk plate 19 in accordance with the leftwards or rightwards movement of the braking member 9 so that the brake lining 18 serves as the brake to repress the corresponding driving wheel 4 from revolving.

On the other hand, the front wheels 5 are provided with front axles 20 at the inside thereof, which are integrally formed with horizontal arms 21 extending backwards in the forward direction. The rear ends of the arms 21 are respectively formed with pins 22 protruding upwards which support both ends of link bar 23. At the substantially center of the link bar 23, a protruding member 24 in U-shape is integrally formed backwards at the rear side surface thereof, and the protruding member 24 is additionally formed with a slot-like opening 24a in the axial direction of the car. The slot-like opening 24a is engaged with the pin 17a disposed at the forward end of the rod 17.

Furthermore, each of the front axles 20 is formed with a pivot pin 20a which is pivotably supported by the chassis so as to be freely rotated. Accordingly, when the braking member 9 is moved rightwards, the front wheels 5 will be turned leftwards about the pivot pins 20a (as shown by the double dotted chain line in FIG. 4). Similarly when the member 9 is moved leftwards, the front wheels will be turned rightwards.

In the body 2, a battery box 25 is slantingly positioned on the chassis 3 (as shown in FIG. 1). A plurality of batteries is housed within the battery box 25 so that the center of gravity is located at a relatively rear area of the body 2 (scarcely forward of the drive axles 4a) on account of the weight of batteries. According to this arrangement, the car will be shifted into the wheelie running mode by suddenly starting or accelerating and kept running in the wheelie running state. The car runs on the front wheel 5 and the rear wheels 4, so called normal running, when the car is not suddenly started or accelerated.

Although the battery box 25 is fixed (incapable of moving the center of gravity) in this embodiment as given explanation above, the battery box may be moved (the position of the center of gravity can be varied) so as to shift freely between the normal running mode (the front wheels 5 and the rear wheels 4 roll along the ground) and the wheelie running mode by moving the center of gravity.

Next, an operation of the embodiment constituted in the above manner will be explained as follows. First of all, when an operator intends to operate the radio controlled car 1 in the normal running mode, he only operates the control box (not shown) to transmit radio commands controlling the car starting slowly in such manner, and the car runs on in the normal state without shifting into the wheelie running mode. In this state, if the operator intends to turn the car, for example leftwards, he may operate the control box to transmit control radio waves for turning leftwards. According to this control signal, the servomotor in the servo box 12 is actuated so that the braking member 9 is moved rightwards through the rotatable lever 13. Thus, the brake lining 18 disposed at the left side of the braking member 9 contacts to the disk 19 fixed at the left side drive axle 4a, thereby repressing the left side rear wheel 4 from revolving. Simultaneously, since the front wheels 5 are turned leftwards in linkage with the movement rightwards of the braking member 9, the radio controlled car 1 is turned leftwards about the left side wheel 4 applied with the brake. At the same time, although the auxiliary wheel 15 is also turned rightward, it does not serve to turn the radio controlled car 1 since it is separated from the ground in the normal running state. Similarly, if the operator intends to turn the radio controlled car rightwards, he may operate the control box to transmit control radio waves for turning rightwards. According to this control signal, the radio controlled car is turned rightwards in a similar manner to the above.

On the other hand, if the operator intends to shift the car into the wheelie running mode, he may operate the control box to transmit control waves so as to suddenly start or accelerate the radio controlled car 1. In this state, the center of gravity will be moved rearwards rather than the drive axles 4a on account of the influence of the inertia caused by the acceleration so that the movement of revolution towards the direction to raise the front wheels 5 is generated. Accodingly, the front wheels 5 are raised and, the auxiliary wheel 15 is landed on the ground; that is, the radio controlled car has been shifted into the wheelie running mode. In this state, if the operator intends to turn the car, for example, leftwards, he may operate the control box to transmit control waves for turning leftwards.

Accordingly, the revolution of the rear left side wheel 4 is repressed in the same manner as the above and simultaneously, the auxiliary wheel 15 is turned rightward. Consequently, the radio controlled car 1 is turned leftwards about the rear left side wheel 4. Although the front wheels 5 are also turned leftwards in the same manner as the above, they can not serve to turn the radio controlled car 1 since they are separated from the ground. Similarly, if the operator intends to turn the radio controlled car rightwards, he may operate the control box to transmit control waves for turning rightwards. According to these control waves, the radio controlled car is turned rightwards in the reverse manner as the above. That is, in such manner, the radio controlled car can be turned in the wheelie running mode.

Additionally, the drive axle 4*a* and rear wheel 4 which are not repressed can be freely revolved on account of the differential gear 7 housed in the differential gear box 6 while the car is turning.

According to this manner, the inventive radio controlled car can be freely turned regardless of the wheelie running condition unlike the conventional car.

As explained above, since the radio controlled car according to the present invention comprises a braking member which is moved by the servomotor actuated in accordance with the direction turning command signal transmitted from the control box, the auxiliary wheel adapted to be rolled along the ground in the wheelie running mode, which can be turned in linkage of the braking member, and further drive wheels repressing mechanism that the intended turning direction side rear wheel fixed to one of the drive axles connected through the differential gear is repressed by the braking member, it can easily be turned even when it is in the wheelie running mode.

It should be also understood that further modifications and variations may be made in the present invention without departing from the spirit of the present invention as set forth in appended claims.

What is claimed is:

1. A radio-controlled car which is wirelessly controlled and capable of moving and turning in a wheelie running state, comprising:

a chassis;

a pair of drive axles mounted on said chassis which are connected to each other through a differential gear;

driving wheels one of which is fixed to each one of said pair of drive axles;

a servomotor mounted on said chassis which is actuated in response to a command signal transmitted from a control box for turning said car, while running, from the forward direction a braking member movably mounted on said chassis which is moved by means including a linkage connecting it with said servomotor so as to control means moving with said drive axles to brake said driving wheel on the side of the car toward which turning is intended to repress the revolution thereof;

following wheels mounted on said chassis which are turned to the intended turning direction by means including a linkage connecting them with said braking member; and an auxiliary wheel mounted on said chassis which is turned to correspond with the intended turning direction by means including a linkage connecting it with said braking member and rolls along the ground during only the wheelie running state.

2. The radio-controlled car as claimed in claim 1, wherein said differential gear is integrally fixed with a differential gear box.

3. The radio-controlled car as claimed in claim 1, wherein said the braking member is allowed to be freely moved in the horizontal direction along guide members protruded from the chassis.

4. In the radio-controlled car as claimed in claim 1, wherein the servomotor revolves in response to radiowaves transmitted from said conrol box, and said linkage between said servomotor and braking member includes a rotatable lever rotated responsive to the revolved angle of the motor, so that the braking member is connected to said servomotor and moved leftwards or rightwards in the horizontal direction through a pin mounted on said lever a protruding member mounted on said braking member and engaged with the pin.

5. The radio-controlled car as claimed in claim 4, wherein said rotatable lever is always biased by a returning force of a spring to urge the rotatable lever backwards so as to quickly return to the normal position.

6. The radio-controlled car as claimed in claim 1, wherein said the braking member includes a pair of brake linings which are respectively secured to the inner surface on left and right side frames of the braking member, said linings being so arranged as to face to each of the outer surfaces of disk plates which are fixed to the drive axles at both sides of a box containing said differential gear.

7. The radio-controlled car as claimed in claim 1, wherein said auxiliary wheel is rotatably mounted to a lever which is pivotably secured to the chassis.

8. In the radio-controlled car as claimed in claim 7 wherein, when the braking member is moved leftwards or rightwards, the rear portion of the lever supporting the auxiliary wheel, will be rotated rightwards or leftwards about the pin in a reverse direction of the braking member.

* * * * *

UNITED STATES PATENT AND TRADEMARK OFFICE

CERTIFICATE OF CORRECTION

PATENT NO. : 4,480,401

DATED : November 6, 1984

INVENTOR(S) : Yukimitsu Matsushiro

It is certified that error appears in the above-identified patent and that said Letters Patent is hereby corrected as shown below:

The Foreign Application Priority Data should show the date as -- Dec. 15, 1982 --.

Column 2, line 23, "resolved" should read -- revolved --;

Column 2, line 35, "figure" should be deleted;

Column 2, line 66, -- portion -- should be insert after "rear";

Column 4, line 47, "Accodingly" should read -- Accordingly --;

Column 6, line 17 (claim 4, line 3), "conrol" should read -- control --;

Column 6, line 19 (claim 4, line 5), -- connected to said servomotor and -- should be insert after "lever";

UNITED STATES PATENT AND TRADEMARK OFFICE

CERTIFICATE OF CORRECTION

PATENT NO. : 4,480,401

DATED : November 6, 1984

INVENTOR(S) : Yukimitsu Matsushiro

It is certified that error appears in the above-identified patent and that said Letters Patent is hereby corrected as shown below:

Column 6, line 21 (claim 4, line 7), "connected to said servomotor and" should be deleted; and Column 6, line 23 (claim 4, line 9), -- and -- should be insert after "lever".

With regard to the changes noted to column 6 above, claim 4 (column 6, lines 15-24) should now read as follows:

4. In the radio-controlled car as claimed in claim 1, wherein the servomotor revolves in response to radio-waves transmitted from said control box, and said linkage between said servomotor and brake member includes a rotatable lever connected to said servomotor and rotated responsive to the revolved angle of the motor, so that the braking member is moved leftwards or rightwards in the horizontal direction through a pin mounted on said lever and a protruding member mounted on said braking member and engaged with the pin.

Signed and Sealed this

*Seventh* Day of *May 1985*

[SEAL]

*Attest:*

DONALD J. QUIGG

*Attesting Officer*

*Acting Commissioner of Patents and Trademarks*